US005765517A

United States Patent [19]

Wiehl

[11] Patent Number: 5,765,517

[45] Date of Patent: Jun. 16, 1998

[54] DEVICE FOR CONTINOUS ANGULAR ADJUSTMENT BETWEEN A CAMSHAFT AND A CRANKSHAFT

[75] Inventor: Hermann Wiehl, Herzogenrauch, Germany

[73] Assignee: INA Waelzlager Schaeffler oHG, Herzogenaurach, Germany

[21] Appl. No.: 868,376

[22] Filed: Jun. 3, 1997

[51] Int. Cl.[6] ..... F01L 1/344

[52] U.S. Cl. ..... 123/90.17; 123/90.31

[58] Field of Search ..... 123/90.15, 90.17, 123/90.31; 74/568 R; 464/1, 2, 160, 161

[56] References Cited

U.S. PATENT DOCUMENTS

| | | | |
|---|---|---|---|
| 5,167,206 | 12/1992 | Suga | 123/90.17 |
| 5,263,442 | 11/1993 | Hara | 123/90.17 |
| 5,535,705 | 7/1996 | Eguchi et al. | 123/90.17 |
| 5,605,121 | 2/1997 | Scheidt et al. | 123/90.17 |

FOREIGN PATENT DOCUMENTS

0486068 A2 5/1992 Germany .

*Primary Examiner*—Weilun Lo
*Attorney, Agent, or Firm*—Henry M. Feiereisen

[57] ABSTRACT

A device for continuously adjusting an angular orientation of a camshaft relative to a crankshaft of an internal combustion engine, includes a housing, an adjusting piston dividing the housing into two pressure compartments and reciprocating in the housing between two end positions in response to operation of a pressure fluid circuit, and a sliding sleeve connected in one piece to the adjusting piston. The sliding sleeve has a first toothed section in mesh with a drive wheel that is in driving relationship with the crankshaft, and a second toothed section in engagement with a toothed bushing that is securely fixed to the camshaft. The toothed sections are formed as helical gears so that an axial displacement of the adjusting piston effects a relative rotation between the drive wheel and the camshaft. In one end position, which represents a starting phase, with the internal combustion engine being at a standstill, the adjusting piston is subjected to a retention force so as to be securely held in place whereby the retention force can be overcome during the starting phase only after buildup of a sufficient pressure in the respective pressure compartment.

15 Claims, 3 Drawing Sheets

DEVICE FOR CONTINOUS ANGULAR ADJUSTMENT BETWEEN A CAMSHAFT AND A CRANKSHAFT

BACKGROUND OF THE INVENTION

The present invention generally refers to an internal combustion engine controlled by gas exchange valves, and more particularly to an adjustment device for continuously adjusting an angular orientation of a camshaft of an internal combustion engine relative to a crankshaft.

Typically, an adjustment device includes a hydraulically actuatable piston which is axially displaceable in opposition to the force applied by a compression spring within a housing so as to form two pressure compartments which are connected to a pressure fluid circuit for alternate supply and discharge of pressure fluid. The adjusting piston is connected in one piece with a hollow cylindrical sliding sleeve which has a first toothed section in mesh with a drive wheel and a second toothed section in geared connection with a toothed bushing which is securely fixed to the camshaft. At a standstill of the internal combustion engine, the adjusting piston bears upon an end stop.

An adjustment device of this type is known from European patent specification EP-B 0 486 068. The change of the angular orientation between the drive wheel and the camshaft is effected by a linear movement, i.e. axial displacement, of the adjusting piston which at standstill of the internal combustion engine is shifted by a compression spring into an end position that is formed by an end face of the housing. In the starting phase of the internal combustion engine, the compression spring loading the adjusting piston is not sufficient to retain the adjusting piston in a stable position. Thus, the adjusting piston is somewhat loose and not precisely guided during the starting phase at least until a required pressure buildup occurs in the pressure compartment. As a consequence, the moment of friction of the camshaft, especially during a cold start of the engine, causes high frequency movements of the piston, resulting in impacts of the adjusting piston on the abutment formed by the housing end face. This uncontrolled movements of the adjusting piston generate noise and promote wear.

SUMMARY OF THE INVENTION

It is thus an object of the present invention to provide an improved adjustment device for continuously adjusting an angular orientation of a camshaft of an internal combustion engine relative to a crankshaft, obviating the afore-stated drawbacks.

In particular, it is an object of the present invention to provide an improved adjustment device which allows a continuous adjustment of an angular orientation of a camshaft of an internal combustion engine relative to a crankshaft in the starting phase, without experiencing uncontrolled movements of the adjusting piston.

These objects and others which will become apparent hereinafter are attained in accordance with the present invention by providing a holding unit that applies a retention force onto the adjusting piston when occupying an end position so that the adjusting piston is securely held in place during a starting phase of the internal combustion engine and axially displaceable only after overcoming the retention force.

The provision of a holding unit retains the adjusting piston in the end position in an exact, pressure-dependent disposition until a minimum pressure builds up in the pressure compartment. Thus, the camshaft occupies a position which enhances the initiation of the internal combustion engine. By temporarily securing the adjusting piston in place during the starting phase in dependence on a pressure, a generation of detrimental noises is eliminated and wear is greatly decreased.

According to one embodiment of the present invention, the holding unit is formed by a magnetic assembly positioned between the housing and the adjusting piston. Through magnetism, the adjusting piston is kept in place in the housing during the starting phase until pressure fluid builds up a sufficient pressure in the respective pressure compartment to overcome the retention force applied by the magnetic assembly so that the adjusting piston can be moved in axial direction toward the cylinder head of the internal combustion engine. A suitable selection and dimensioning of the magnetic assembly may even render the use of a compression spring to load the adjusting piston in direction toward the end face of the housing during start of the engine, redundant.

According to another embodiment of the present invention, the adjusting piston has a conical outer configuration which bears in the end position of the adjusting piston in form-fitting manner upon a complementary cone-shaped inner configuration of the housing, thereby forming a wedge action between the interacting conical sections. This results in a certain self-locking effect by which the adjusting piston of the internal combustion engine is securely held in place until a predetermined pressure builds up in the pressure compartment to overcome the retention force and to enable an axial displacement of the adjusting piston. The thus formed clamping cone assembly also ensures a desired disposition of the adjusting piston in the starting phase.

According to another feature of the present invention, the magnetic assembly includes a permanent magnet to apply a steady, constant force. Preferably, the magnetic assembly includes a first permanent magnet at an end face of the adjusting piston and a second permanent magnet at an end face of the housing in opposite disposition to the first permanent magnet. The opposing end faces of the permanent magnets exhibit reverse magnetic polarity to create mutually attracting forces, thereby effecting the desired retention force by which the adjusting piston is securely kept in place at the housing in the starting phase of the internal combustion engine, until the pressure in the pressure compartment reaches a level to overcome the retention force.

The use of a permanent magnet is advantageous because it allows an indefinite application of a magnetic force, without requiring external excitation, and thus is especially suitable for a camshaft adjustment device for generating a limited retention force of the adjusting piston in the starting phase.

In order to effect a uniform magnetic force and to eliminate generation of oblique force components on the adjusting piston, the end faces of the permanent magnets extend parallel to one another. This parallel disposition of the end faces of both permanent magnets results in an optimal flux of the magnetic field lines so that both permanent magnets generate a greatest possible attractive force.

It is certainly within the scope of the present invention to incorporate a permanent magnet in only one of the components, e.g. in the housing for interaction with an adjusting piston that is made of ferromagnetic material, or in the adjusting piston for interaction with a housing portion that is made of ferromagnetic material.

Alternatively, the permanent magnets may also be embedded in the adjusting piston and in the housing in respective receptacles made of plastics or non-ferrous material. This prevents effectively a material separation from the relatively brittle magnetic material. It is also conceivable, in order to reduce the brittleness of the magnetic material, to make the permanent magnet from a suitable composite.

According to yet another feature of the present invention, the adjusting piston exhibits a conical outer configuration to fit in the end position in a complementary housing portion to effect a wedge action between the conical interfaces of these components, whereby the thus formed clamping cone assembly is defined by a taper angle which is equal to or smaller than 20° C. At this angle range, a self-locking effect is attained between these components to provide only a limited retention force that is sufficient to securely keep the adjusting piston in place during the starting phase of the engine, while still allowing the adjusting piston to move from the starting position when a full pressure buildup occurs in the pressure compartment.

According to still another feature of the present invention, the adjusting piston is spaced in the end position from the opposing end face of the housing by a distance of equal to or greater than 0.1 mm. This distance is especially required in the event the retention force is created through a wedge action between the conical interfaces of the adjusting piston and the housing so that as a consequence of wear a shift of the adjusting piston in direction toward the housing end face prevents the adjusting piston from direct contacting the housing end face that would otherwise render the wedge action ineffective.

In order to eliminate any development of noise, a damping ring may be positioned between the adjusting piston and the opposing end face of the housing in the end position of the adjusting piston. Suitably, the damping ring is formed as a wide O-ring of rubber which may be received in an axial groove of the housing end face or of the piston and juts axially outwards for bearing upon the opposing component. The damping ring further enhances the wear resistance because an impact of the adjusting piston can thereby be cushioned.

It is also within the scope of the present invention to provide a holding unit in the form of permanent magnets or wedge action, which applies a defined retention force on the adjusting piston in the starting phase of the internal combustion engine. Preferably, the retention force acting on the adjusting piston is so defined as to match an adjustment force which is equal to or greater than 10% of the pressure in the pressure compartment as encountered during operation of the internal combustion machine.

According to still another variation of the present invention, the holding unit may be a combination of a wedge action between the adjusting piston and the housing and the provision of a magnetic assembly. This combination permits formation of a clamping cone assembly so defined by an angle of taper as to eliminate any risk of an uncontrolled self-locking action while allowing the use of smaller permanent magnets to optimize the available space.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
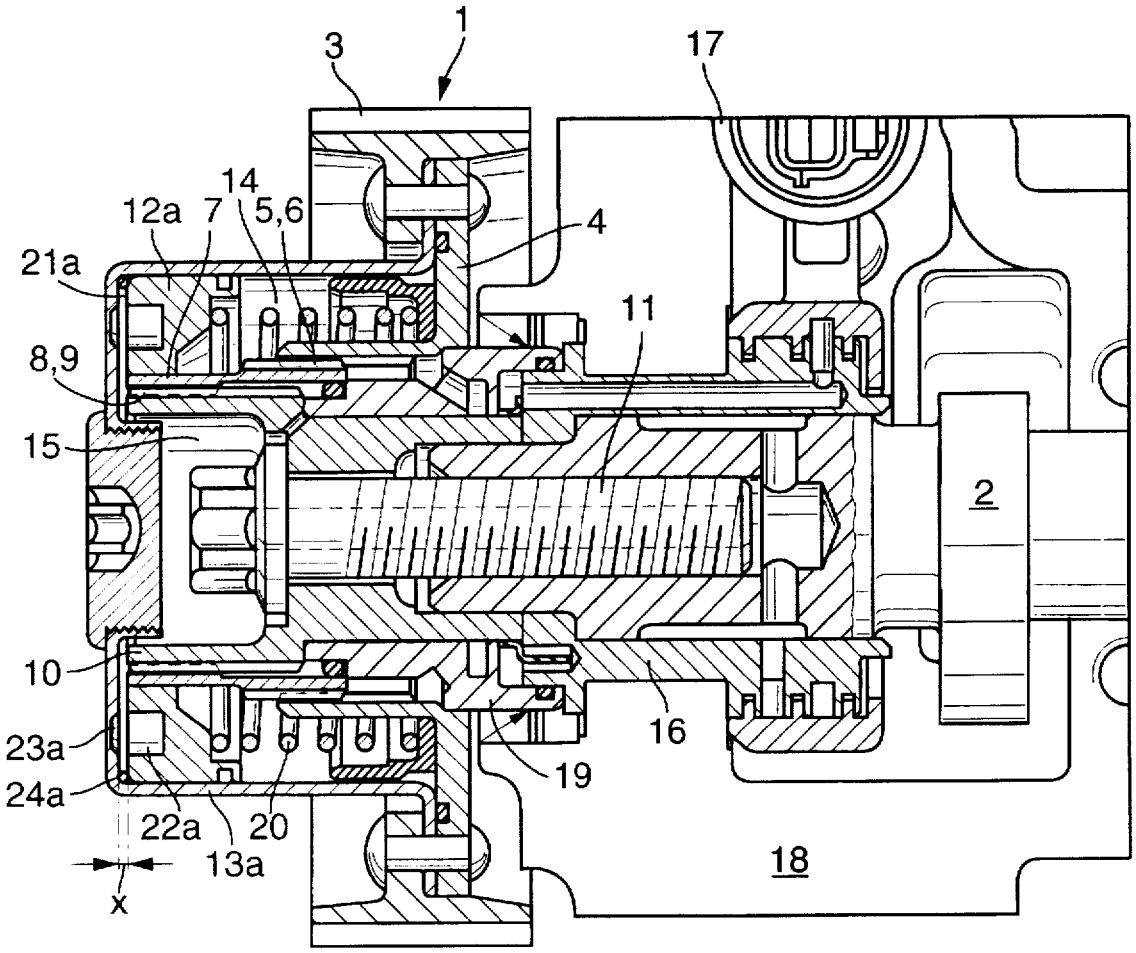
FIG. 1 is a longitudinal section of a first embodiment of a device for continuously adjusting an angular orientation of a camshaft relative to a crankshaft, in accordance with the present invention, illustrating the arrangement of permanent magnets for applying a retention force.

Throughout all the Figures, the same or corresponding elements are generally indicated by the same reference numerals.

Turning now to the drawing, and in particular to FIG. 1, there is shown a first embodiment of an adjustment device in accordance with the present invention and generally designated by reference numeral 1 for continuously adjusting an angular orientation of a camshaft 2 relative to a crankshaft (not shown) of an internal combustion engine. The adjustment device 1 is arranged in axial prolongation of the camshaft 2 which is provided for opening and closing of respective gas exchange valves of the internal combustion engine. The camshaft 2 is connected to a drive wheel 3 which is driven by a timing chain for transmitting torque from the crankshaft. The drive wheel 3 is connected in one piece with a ring member 4 which is interiorly in mesh with a sliding sleeve 7 via a respective helical toothed section 5, 6. A helical toothed section 8, 9 engages the sliding sleeve 7 with a toothed bushing 10 which is offset radially inwardly. A screwed connection 11 so secures the toothed bushing 10 on the camshaft 2 that a relative rotation between the toothed bushing 10 and the camshaft 2 is prevented.

On the camshaft-distal end face, the sliding sleeve 7 is formed in one piece with an adjusting piston 12*a* which is received in an inner space of a housing 13*a* and suitably sealed therefrom. The adjusting piston 12 bears with its sleeve distal end face on an inner wall of the housing 13*a* to thereby subdivide the housing 13*a* into two cylindrical pressure compartments 14, 15. The housing 13*a* exhibits a rotationally symmetrical configuration and is securely fixed to the drive wheel 3. An axial displacement of the adjusting piston 12 is effected by alternating supply and discharge of pressure fluid to and from the pressure compartments 14, 15 via a suitable pressure fluid circuit which is conducted via an adapter 16. The adapter 16 is provided with a control valve 17 which is arranged in a cylinder head 18 of the internal combustion engine for controlling admission of pressure fluid to the pressure compartments 14, 15.

As a result of the meshing helical toothed sections 5, 6 and 8, 9, an axial displacement of the adjusting piston 12*a* effects a change of the angular orientation between the drive wheel 3 and the toothed bushing 10 and thus of the camshaft 2 in view of the fixed connection between the toothed bushing 10 and the camshaft 2. In order to ensure a rotation of the concentrically arranged components relative to one another, the ring member 4 is connected in one piece with a guide bush 19 which is rotatably mounted on the toothed bushing 10.

In order to shift the adjusting piston 12*a* into the starting position shown in FIG. 1 and to influence the adjusting speed of the adjusting piston 12*a* during operation, the pressure compartment 14 accommodates a compression spring 20 which loads the adjusting piston in direction of an end face 21*a* of the housing 13*a*. In the starting position, the adjusting piston 12*a* is thus moved by the compression spring 20 to the leftmost position. So as to securely retain the adjusting piston 12*a* in place in this position, the adjustment device 1 includes a holding unit that applies a retention force and is formed by disposing a permanent magnet 22*a* in a pocket at the end face of the adjusting piston 12*a* and by disposing a permanent magnet 23*a* in a pocket at the end face 21*a* of the housing 13*a*, whereby the permanent magnets 22*a*, 23*a* oppose one another in parallel disposition and are of reverse polarity. Although not shown in detail in the drawings, it is certainly conceivable to provide a plurality of permanent magnets 22*a*, 23*a* which are evenly spaced about the periphery of the housing 13*a* and the adjusting piston 12*a*, respectively, in order to permit variations of the attractive force applied by the holding unit and thereby to allow a desired defined disposition of the adjusting piston 12*a*. The retention force applied by the permanent magnets 22*a*, 23*a* prevents in the starting phase of the internal combustion engine an uncontrolled movement of the adjusting piston 12*a* until a certain pressure builds up in the pressure compartment 15.

Suitably, a damping ring 24*a* is positioned between the opposing end faces of the housing 13*a* and the adjusting piston 12*a* in order to prevent a direct impact of the adjusting piston 12*a* on the end face 21*a* of the housing 13*a*. The damping ring 24*a* may be inserted in a suitable axial groove of either one the components, adjusting piston 12*a* or end face 21*a* of the housing 13*a*, and bear upon the opposing other one of the components. The incorporation of the damping ring 24*a* creates between the housing 13*a* and the adjusting piston 12*a* an axial spacing X in the range of equal to or greater than 0.1 mm.

It will be understood by persons skilled in the art, that a holding unit based upon application of a magnetic force may also be accomplished by using only one permanent magnet in either one of the components, adjusting piston and housing, with the other one of the components being then formed of a ferromagnetic material.

The adjustment device 1 shown in FIG. 1 operates as follows.

FIG. 1 shows the starting position in which the adjusting piston 12*a* is loaded by the compression spring to the leftmost position and retained securely in place by the attractive force created between the permanent magnets 22*a*, 23*a*. When the pressure in the pressure compartment 15 is increased and reaches a certain level, the pressure is able to overcome the retention force and moves the piston 12*a* in opposition to the spring force created by the compression spring 20 in direction toward the cylinder head 18 toward the other end position. The displacement of the piston 12*a* is accompanied by a relative rotation between the drive wheel 3 and the toothed bushing 10, as described above. The mode of operation of the adjustment device 1 to effect a desired angular orientation between the camshaft 2 and the drive wheel 3 is generally known and therefore is not described in more detail for sake of simplicity.

Figure 2:
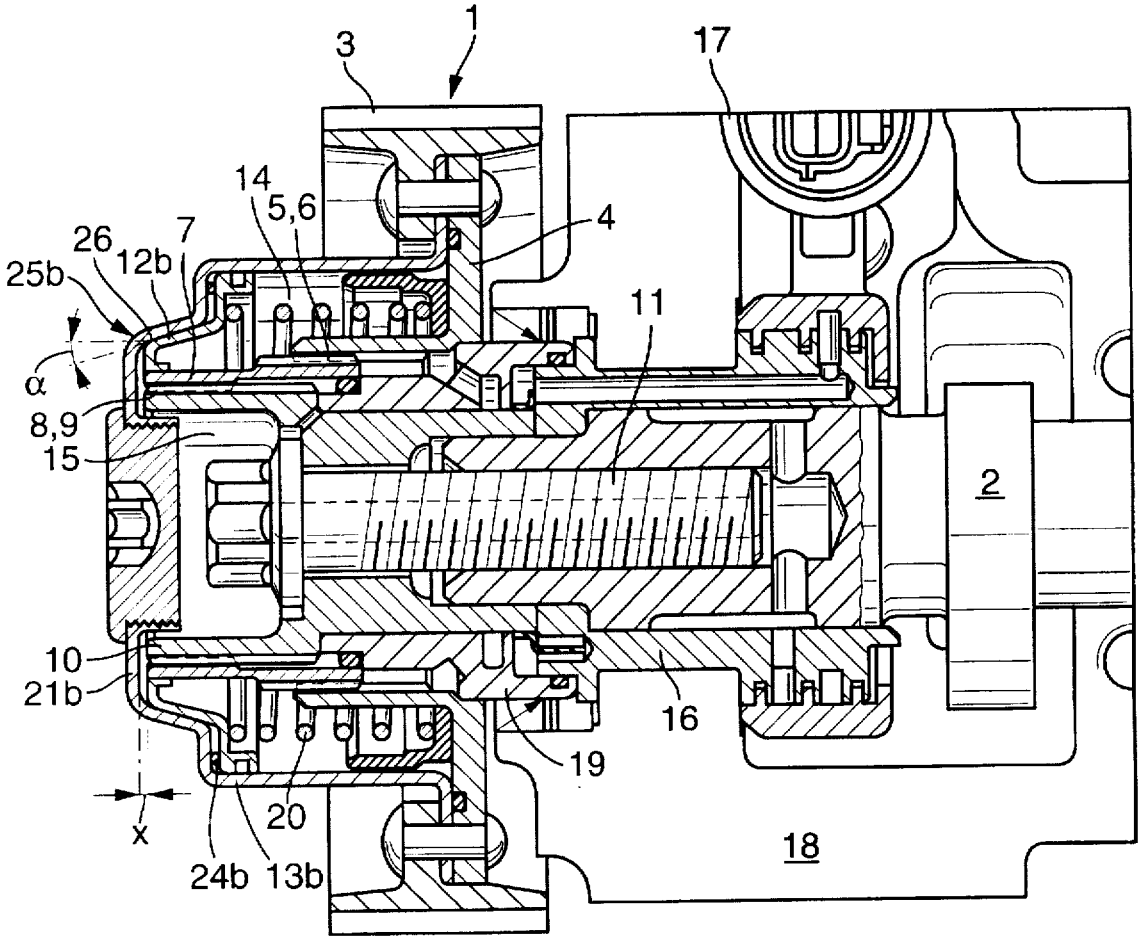
FIG. 2 is a longitudinal section of a second embodiment of a device for continuously adjusting an angular orientation of a camshaft relative to a crankshaft, in accordance with the present invention, illustrating the formation of a wedge action between interfacing conical sections for applying a retention force.

Turning now to FIG. 2, there is shown a longitudinal section of a second embodiment of an adjustment device 1 for continuously adjusting an angular orientation of the camshaft 2 relative to the crankshaft. Parts corresponding with those in FIG. 1 are denoted by identical reference numerals and not explained again. In this embodiment, provision is made for a holding unit which is based on application of a retention force formed through a wedge action, instead of a magnetic assembly. The adjustment device 1 includes an adjusting piston 12*b* which has a conically shaped outer surface area 26 for interaction with a complementary conical inner configuration of the end face 21*b* of the housing 13*b*. The conical interfaces formed by the piston 12*b* and the end face 21*b* create a clamping cone assembly, generally designated by reference numeral 25*b* to form a wedge action between the conical interfaces, with the conical interfaces of the adjusting piston 12*b* and the end face 21*b* being so defined by an angle of taper $\alpha$ as to permit a limited self-locking effect and thus retention force. Suitably, the taper angle $\alpha$ is equal to or smaller than 20° C. After buildup of a sufficient pressure in the pressure compartment 15, the wedge action can be overcome to allow an axial displacement of the adjusting piston.

In order to prevent a direct contact of the adjusting piston 12*b* on the end face 21*b* of the housing 13*b* and to prevent a permanent wedge action of the clamping cone 25*b* when, due to wear, the adjusting piston 12*b* is shifted in direction of the housing end face 21*b*, the adjusting piston 12*b* and the housing end face 21*b* are so sized as to form a spacing X which is equal to or greater than 0.1 mm. Suitably a damping ring 24*b* is placed between the adjusting piston 12*b* and the housing end face 21*b* to avoid a sudden impact of the adjusting piston 12*b* on the housing 13*b* and thus development of noise.

Figure 3:
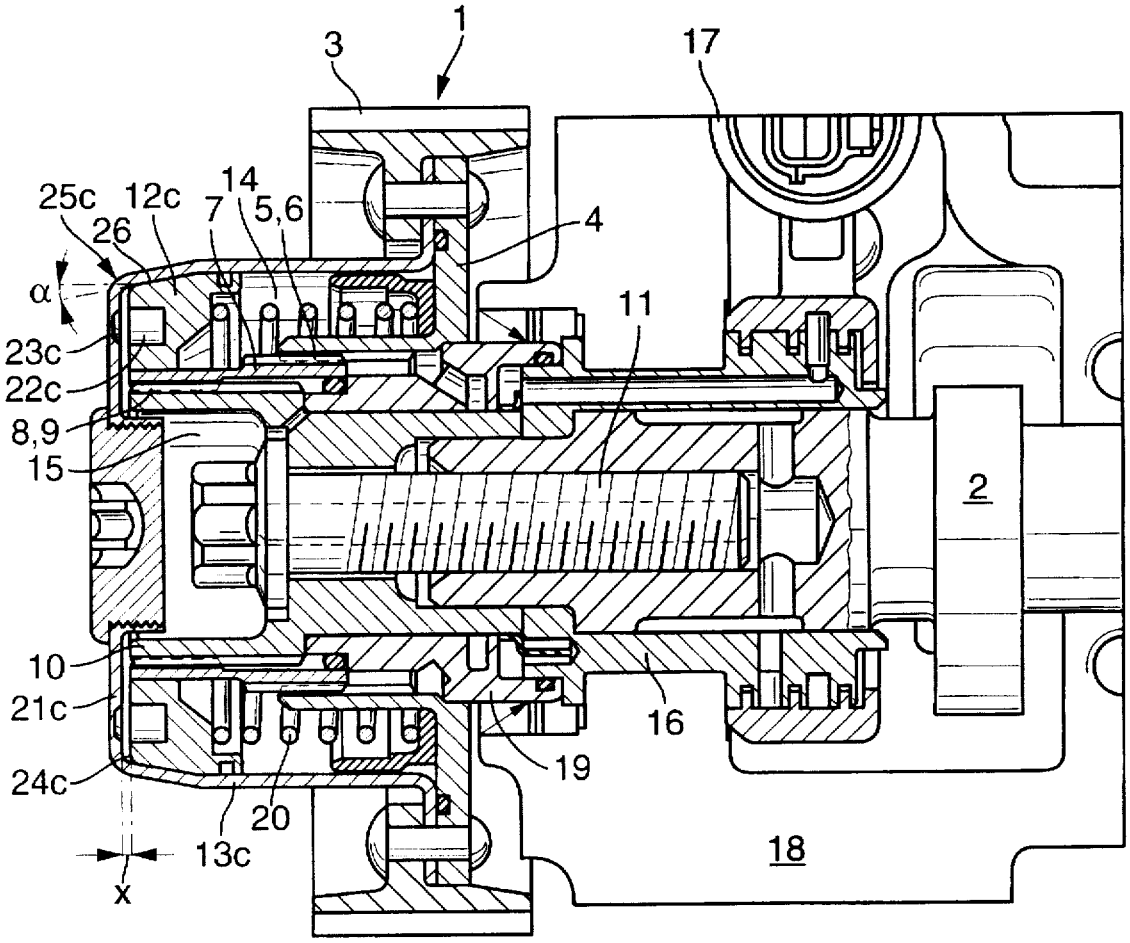
FIG. 3 is a longitudinal section of a third embodiment of a device for continuously adjusting an angular orientation of a camshaft relative to a crankshaft, in accordance with the present invention, illustrating a combination of permanent magnets and formation of a wedge action between interfacing conical sections for applying a retention force.

Turning now to FIG. 3, there is shown a longitudinal section of a third embodiment of an adjustment device 1 for continuously adjusting an angular orientation of the camshaft 2 relative to the crankshaft. Parts corresponding with those in FIG. 1 are also denoted by identical reference numerals and not explained again. In this embodiment, provision is made for a holding unit which is based on application of a retention force formed by a combination of wedge action and magnetic assembly. The adjustment device 1 includes an adjusting piston 12*c* which is so configured as to form with a complementary housing 13*c* a clamping cone assembly, generally denoted by reference numeral 25*c* to effect a wedge action between the conical interfaces. In addition, the adjusting piston 12*c* has incorporated at the end face in opposition to the housing end face 21*c* a permanent magnet 22*c* which interacts with a permanent magnet 23*c* in the housing end face 23*c*. The combination of clamping cone assembly 25*c* and magnetic assembly 22*c*, 23*c* allows creation of a wedge action which is so sized as to eliminate the risk of an uncontrolled self-locking effect, and the provision of smaller permanent magnets. In the end position of the adjusting piston, as shown in FIG. 3, the clamping cone assembly 25*c* ensures a centered disposition of the adjusting piston 12*c* and generates a limited retention force which is further increased by the attractive forces generated by the permanent magnets 22*c*, 23*c*. A damping ring 24*c* is also positioned between the adjusting piston 12*c* and the housing 13*c* to effect a spacing X between these components and cushioning any impacting.

While the invention has been illustrated and described as embodied in a device for continuous angular adjustment between a camshaft and a crankshaft, it is not intended to be limited to the details shown since various modifications and structural changes may be made without departing in any way from the spirit of the present invention.

What is claimed as new and desired to be protected by letters patent is set forth in the appended claims.

What is claimed is:

1. A device for continuously adjusting an angular orientation of a camshaft relative to a crankshaft of an internal combustion engine, comprising:

a housing;

adjustment means secured to the camshaft for changing a relative rotational angle of the camshaft with respect to a drive element in driving relationship with the crankshaft, said adjustment means including an adjusting piston dividing the housing into two pressure compartments and reciprocating in the housing between two end positions in response to operation of a pressure fluid circuit, and a sliding sleeve connected in one piece to the adjusting piston, said sliding sleeve having a first geared section in mesh with the drive element, and a second geared section in engagement with a geared bushing securely fixed to the camshaft;

spring means so loading the adjusting piston as to seek one end position representing a starting phase of the internal combustion engine; and holding means for applying a retention force onto the adjusting piston when occupying the one end position so that the adjusting piston is axially displaceable in the starting phase of the internal combustion engine only after overcoming the retention force.

2. The device of claim 1 wherein the holding means includes a magnetic assembly positioned between the housing and the adjusting piston.

3. The device of claim 1 wherein the adjusting piston has a conical outer configuration, said housing defining an end face which has a conical inner configuration complementing the conical outer configuration of the adjusting piston, with the adjusting piston bearing upon the end face in form-fitting engagement when occupying the one end position so as to form a clamping cone assembly effecting a wedge action between the conical interfaces.

4. The device of claim 2 wherein the magnetic assembly includes a permanent magnet.

5. The device of claim 4 wherein the magnetic assembly includes a first permanent magnet arranged in an end face of the adjusting piston and a second permanent magnet arranged in an end face of the housing and opposing the first permanent magnet.

6. The device of claim 5 wherein the first and second permanent magnets have opposing magnetic polarity.

7. The device of claim 6 wherein the first and second permanent magnets have end faces in parallel disposition.

8. The device of claim 2 wherein one component selected from the group consisting of housing and adjusting piston is made of ferromagnetic material, with another component of the group including a magnetic member arranged in an end face thereof for interaction with the one component.

9. The device of claim 5 wherein the first permanent magnet is received in the adjusting piston in a receptacle made of a material selected from the group consisting of plastics and non-ferrous material, and the second permanent magnet is received in the housing in a receptacle made of a material selected from the group consisting of plastics and non-ferrous material.

10. The device of claim 3 wherein the clamping cone assembly defines an angle of taper of at most 20° C.

11. The device of claim 1 wherein the adjusting piston is spaced in the one end position from an opposing end face of the housing by a distance of at least 0.1 mm.

12. The device of claim 1, and further comprising a damping ring positioned between the adjusting piston and an opposing end face of the housing.

13. The device of claim 1 wherein the holding means applies a retention force which matches a displacement force by which the adjusting piston is moved and which is at least 10% of a pressure exerted in a respective one of the pressure compartments during operation of the internal combustion engine.

14. The device of claim 1 wherein the holding means includes a combination of a magnetic assembly positioned between the housing and the adjusting piston and a clamping cone assembly to effect a wedge action between conical interfaces of the adjusting piston and the housing.

15. A device for continuously adjusting an angular orientation of a camshaft of an internal combustion engine relative to a drive element in driving relationship with a crankshaft, comprising:

a housing;

an adjusting piston dividing the housing into two pressure compartments which are connected to a pressure fluid circuit for supply and discharge of pressure fluid, thereby effecting a displacement of the adjusting piston in an axial direction of the camshaft between two end positions and thereby a change of a rotational angle of the camshaft relative to the drive element, with one end position being occupied by the adjusting piston during a starting phase of the internal combustion engine; and a non-spring type holding means for applying a retention force onto the adjusting piston for securing the adjusting piston in place when occupying the one end position, said retention force being of such magnitude that the adjusting piston is kept stationary during the starting phase of the internal combustion engine until a minimum pressure has built up in a respective one of the pressure compartments to displace the adjusting piston in the axial direction.

* * * * *